US011260281B2

(12) United States Patent
Ho

(10) Patent No.: US 11,260,281 B2
(45) Date of Patent: Mar. 1, 2022

(54) AUTOMATIC CARD SHUFFLER AND CARD BOX RACK OF THE AUTOMATIC CARD SHUFFLER

(71) Applicant: TAIWAN FULGENT ENTERPRISE CO., LTD., Taipei (TW)

(72) Inventor: Cai Shiang Ho, Taipei (TW)

(73) Assignee: TAIWAN FULGENT ENTERPRISE CO., LTD., Taipei (TW)

( * ) Notice: Subject to any disclaimer, the term of this patent is extended or adjusted under 35 U.S.C. 154(b) by 432 days.

(21) Appl. No.: 16/526,200

(22) Filed: Jul. 30, 2019

(65) Prior Publication Data

US 2021/0031094 A1 Feb. 4, 2021

(51) Int. Cl.

| | |
|---|---|
| ***A63F 1/12*** | (2006.01) |
| ***A63F 1/10*** | (2006.01) |
| *A63F 11/00* | (2006.01) |
| *A63F 1/08* | (2006.01) |
| *A63F 1/06* | (2006.01) |

(52) U.S. Cl.

CPC ..... *A63F 1/10* (2013.01); *A63F 1/12* (2013.01); *A63F 1/062* (2013.01); *A63F 1/08* (2013.01); *A63F 11/0002* (2013.01)

(58) Field of Classification Search

CPC .... A63F 1/062; A63F 1/10; A63F 1/12; A63F 11/0002

USPC ..... 273/149 R, 149 P; 463/22

See application file for complete search history.

(56) References Cited

U.S. PATENT DOCUMENTS

| | | | | |
|---|---|---|---|---|
| 2,099,187 | A * | 11/1937 | Atti | A63F 1/12 273/149 R |
| 6,837,792 | B2 * | 1/2005 | Cranford | A63F 1/12 463/42 |
| 7,874,559 | B1 * | 1/2011 | Tseng | A63F 1/12 273/149 R |
| 9,114,315 | B1 * | 8/2015 | Tseng | G07F 17/26 |
| 9,586,131 | B2 * | 3/2017 | Shigeta | A63F 1/14 |
| 2012/0169009 | A1 * | 7/2012 | Tseng | A63F 1/14 273/149 R |

* cited by examiner

*Primary Examiner* — Benjamin Layno

(74) *Attorney, Agent, or Firm* — Tracy M Heims; Apex Juris, PLLC

(57) ABSTRACT

An automatic card shuffler has a shuffling device having a card exit and a card box rack. The card box rack has a connecting arm mounted on the shuffling device and a pivot shelf. The pivot shelf is pivotally connected on the connecting arm and is adapted to accommodate the card box. The pivot shelf is adapted to pivot relative to the connecting arm to a first position and a second position. In the first position, the cover of the card box is easy to be sealed. In the second position, the cover opens due to gravity and the opening of the card box is aligned to the card exit of the shuffling device. Therefore, when the poker cards are dispensing, the poker cards pass through the opening, enter the card box, and are stacked inside the card box to be sealed.

15 Claims, 8 Drawing Sheets

AUTOMATIC CARD SHUFFLER AND CARD BOX RACK OF THE AUTOMATIC CARD SHUFFLER

BACKGROUND OF THE INVENTION

1. Field of the Invention

The present invention relates to a card box rack of an automatic card shuffler for poker.

2. Description of the Prior Arts

Nowadays, a casino has an automatic card shuffler on each poker table. A dealer uses the automatic card shuffler to shuffle the poker cards and then deals the poker cards to the players. With reference to FIG. 8, the aforementioned automatic card shuffler has a card entrance base 91, a shuffling device 92, and a dealing shoe 93. The dealer puts the poker cards into the card entrance base 91, and then the poker cards are delivered to the shuffling device 92 to be shuffled. After shuffling, the poker cards are delivered into the dealing shoe 93, waiting for the dealer to draw out and deal the cards to the players one by one.

However, how many automatic card shufflers are needed is equal to how many poker tables are provided, and therefore the poker cards can be shuffled automatically and randomly in every poker table in order to exclude human factors and maintain fairness. Because of this, a cost to run a casino is increased massively.

In addition, to each poker table, a card deck must be delivered back into the automatic card shuffler for shuffling when the card deck is fully used, so the players have to wait for the automatic card shuffler to finish shuffling between rounds. This is not only inefficient but also eliminates excitement of the games due to the long waiting time.

To overcome the shortcomings, the present invention provides a card box rack to mitigate or obviate the aforementioned problems.

SUMMARY OF THE INVENTION

The main objective of the present invention is to provide a card box rack that can deliver the poker cards into a transparent card box to be sealed after the poker cards are shuffled. Therefore, by continuously shuffling multiple decks of poker cards and delivering them into multiple card boxes to be sealed, a new shuffled deck can be immediately provided to be unpacked and used after the last deck is fully used. Thus, all the poker tables in the casino can be run by only one automatic card shuffler so that the cost is massively reduced and the waiting time between rounds is significantly shortened.

The card box rack is adapted to be mounted on a shuffling device to accommodate a card box, wherein the shuffling device has a card exit, and the card box is a hexahedron and has a cover, an abutting surface, a placing surface, and two first surfaces. The cover and the placing surface are two opposite surfaces of the card box respectively. The abutting surface is connected between the cover and the placing surface. The two first surfaces are another two opposite surfaces of the card box respectively and each of the first surfaces is connected between the cover, the abutting surface, and the placing surface. The cover is adapted to be open to form an opening. The card box rack has a connecting arm, a pivot stopper, and a pivot shelf. The connecting arm has a first end and a second end. The first end is adapted to be mounted on the shuffling device. The second end is opposite to the first end. The pivot stopper is mounted on the connecting arm. The pivot shelf is pivotally connected to the connecting arm and is adapted to accommodate the card box. The pivot shelf is adapted to pivot relative to the connecting arm to a first position or a second position. When the pivot shelf pivots to the first position, the placing surface of the card box is located in a bottom of the card box and the pivot shelf abuts the pivot stopper. When the pivot shelf pivots to the second position, the abutting surface of the card box is located in the bottom of the card box and the pivot shelf makes the opening of the card box aligned to the card exit of the shuffling device.

By pivotally connecting the pivot shelf on the connecting arm, the pivot shelf can be turned to the first position and the card box can be placed on the pivot shelf by using the placing surface as a bottom surface. Then, the pivot shelf pivots to the second position and the card box is turned into a position where the abutting surface is disposed as the bottom surface. As this time, the gravity makes the cover slide toward the abutting surface (which means sliding downward) and open the opening, and the opening is exactly aligned to the card exit of the shuffling device. Therefore, when the shuffling device dispenses the poker cards from the card exit, the poker cards pass through the opening of the card box, enter the card box, and are stacked inside the card box facing to the abutting surface. At last, the staff of the casino seals the card box until a new deck is needed.

Therefore, by continuously shuffling multiple decks of poker cards and delivering them into multiple card boxes to be sealed, a new shuffled deck can be immediately provided to be unpacked and used after the last deck is fully used. Thus, all the poker tables in the casino can be run by only one automatic card shuffler so that the cost is massively reduced and the waiting time between rounds is significantly shortened.

Other objectives, advantages and novel features of the invention will become more apparent from the following detailed description when taken in conjunction with the accompanying drawings.

DETAILED DESCRIPTION OF THE PREFERRED EMBODIMENTS

Figure 1:
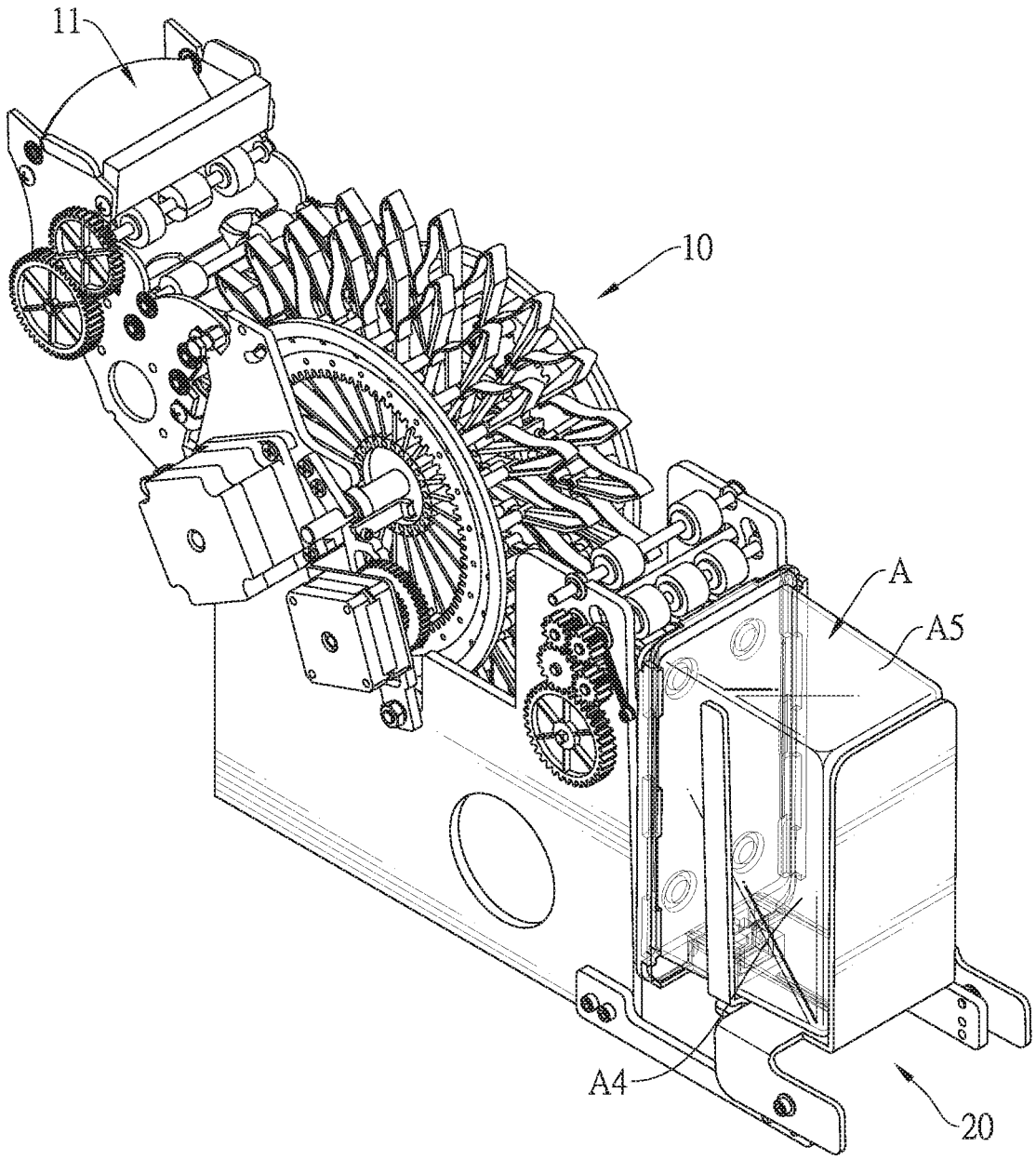
FIG. 1 is a perspective view of a shuffling device and a card box rack in accordance with the present invention.
Figure 4:
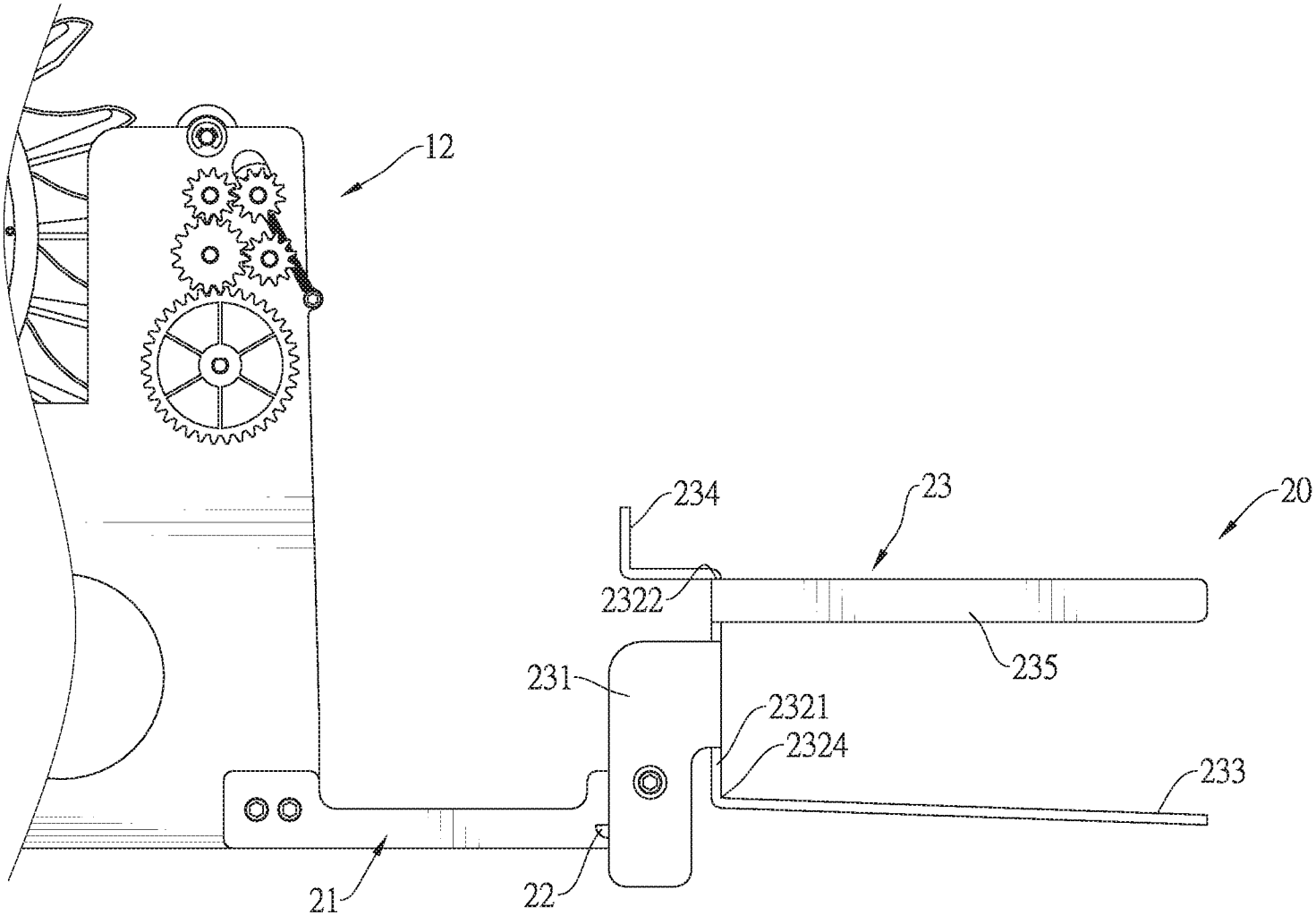
FIG. 4 is a side view of the card box rack in FIG. 1.
Figure 5:
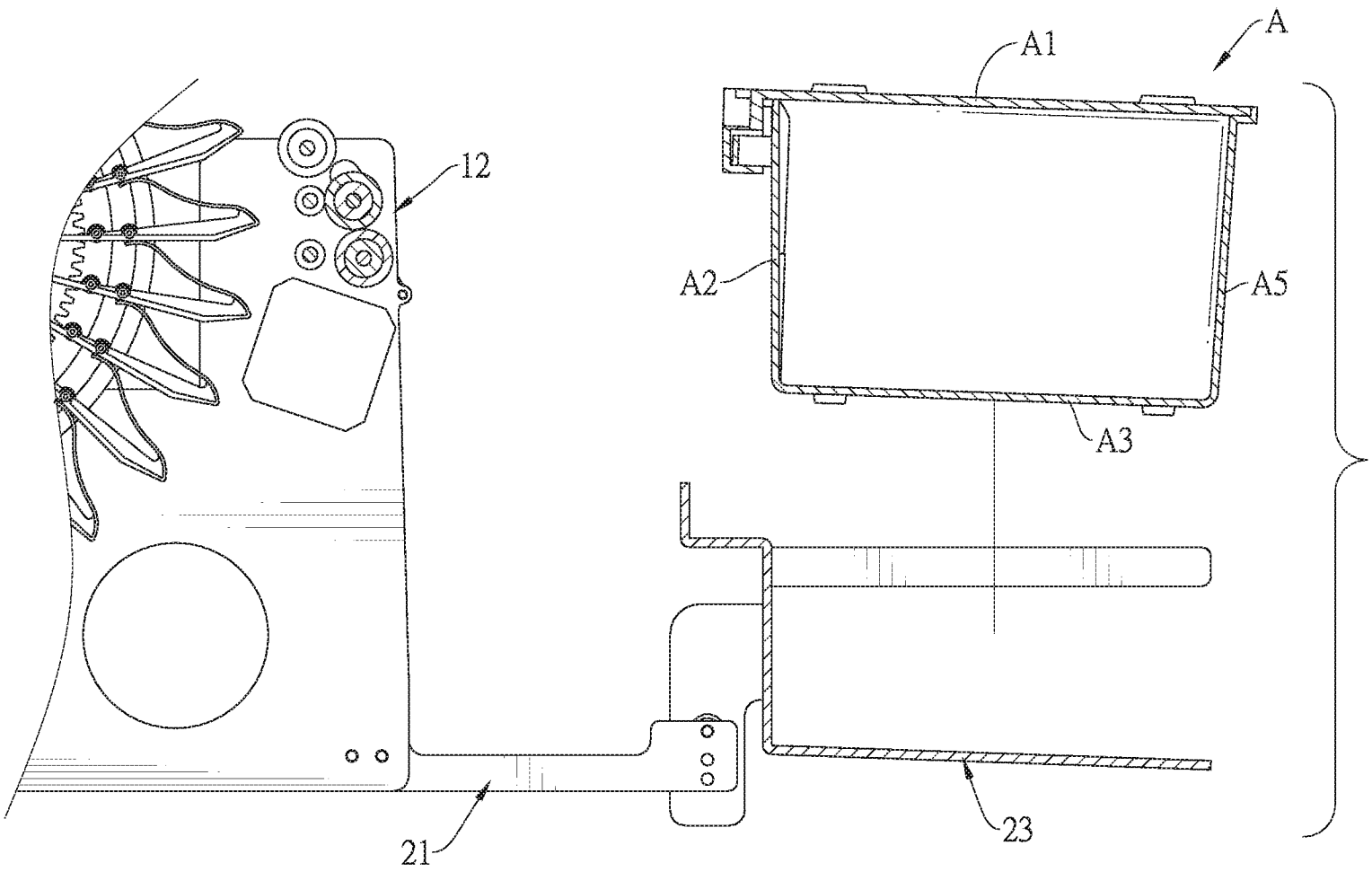
FIGS. 5, 6, and 7 are side operational views in cross section of the card box rack in FIG. 1; showing the automatic card shuffler accommodating the card box when in use.

With reference to FIGS. 1, 4 and 5, an automatic card shuffler in accordance with the present invention is adapted to accommodate a card box A. The card box A is a hexahedron and has a cover A1, an abutting surface A2, a placing surface A3, two first surfaces A4, and a second surface A5. The cover A1 and the placing surface A3 are two opposite surfaces of the card box A. The abutting surface A2 is connected between the cover A1 and the placing surface A3. The two first surfaces A4 are two opposite surfaces of the card box A and each of the first surfaces A4 is connected between the cover A1, the abutting surface A2, the placing surface A3, and the second surface A5. The second surface A5 and the abutting surface A2 are another two opposite surfaces of the card box A. The cover A1 is adapted to slide along a direction from the second surface A5 to the abutting surface A2 to open and to form an opening A6. The way in which the cover A1 opens is not limited to the abovementioned. Specifically, for storage, the card box A is placed flat with the placing surface A3 as a bottom surface, and the cover A1 is located on a top surface of the card box A and slides horizontally toward the abutting surface A2 to open the upward opening A6. Further, poker cards abut the placing surface A3 inside the card box A by their edges, and face to the abutting surface A2 during storage.

Figure 2:
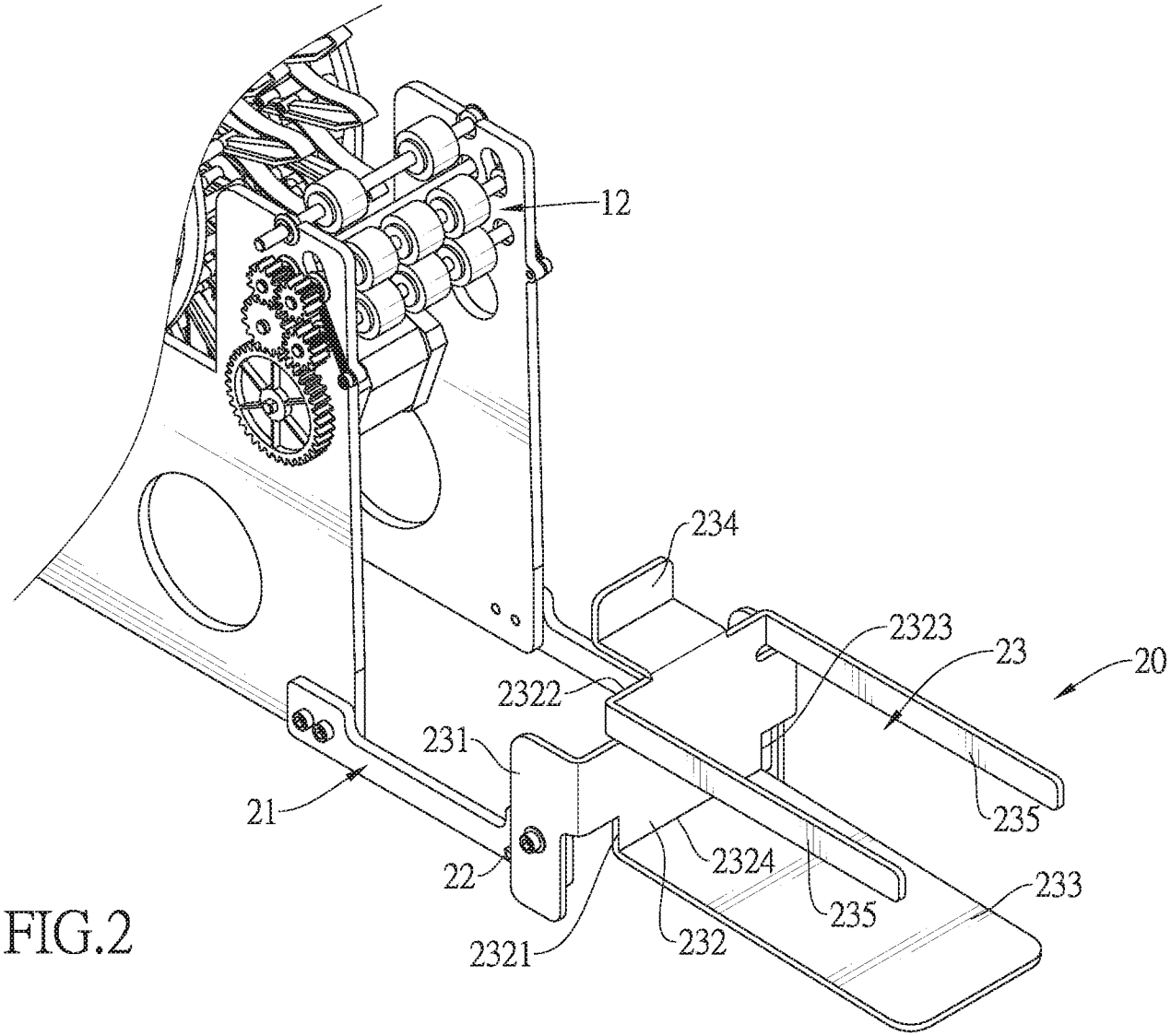
FIGS. 2 and 3 are perspective operational views of the card box rack in FIG. 1.
Figure 3:
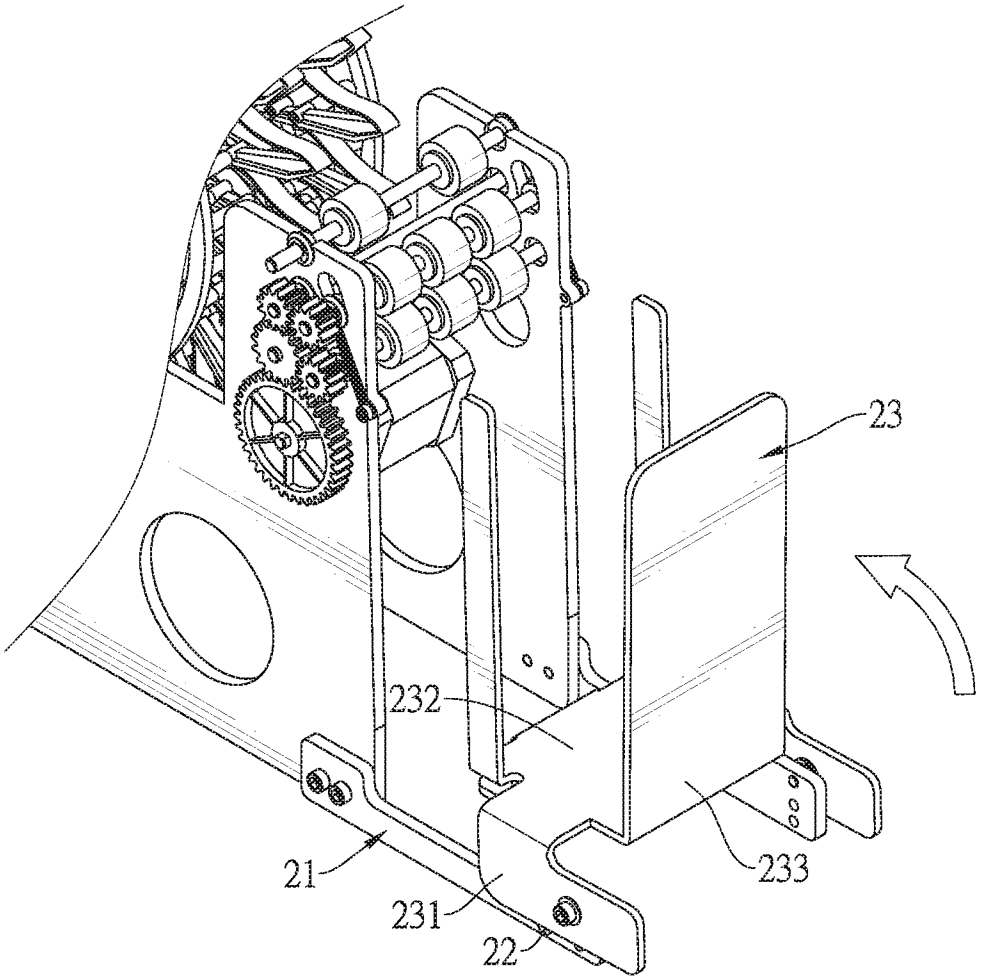

With further reference to FIGS. 1, 2 and 3, the automatic card shuffler has a shuffling device 10 and a card box rack 20.

The shuffling device 10 has a card entrance end having a card entrance 11 and a card exit end being opposite to the card entrance end and having a card exit 12. For shuffling, poker cards are put into the shuffling device 10 from the card entrance 11. After shuffling, the shuffling device 10 dispenses the poker cards faced down and one by one from the card exit 12.

The card box rack 20 has a connecting arm 21, a pivot stopper 22, and a pivot shelf 23.

The connecting arm 21 has a first end and a second end which are opposite to each other. The first end is adapted to be mounted on the card exit end of the shuffling device 10.

With further reference to FIGS. 2, 3 and 4, the pivot stopper 22 is mounted on the connecting arm 21. Specifically, in this embodiment, the pivot stopper 22 is, but not limited to, a column protruding horizontally from the connecting arm 21. The function of the pivot stopper 22 is to stop the pivot shelf 23 from pivoting relative to the connecting arm 21 in a specific position, which means the pivot stopper 22 is designed to limit the pivot shelf 23. So the pivot stopper 22 can be implemented in any configuration and be mounted on any position as long as the pivot shelf 23 is adapted to stop the pivot shelf 23 from pivoting relative to the connecting arm 21 in a specific position.

Figure 6:
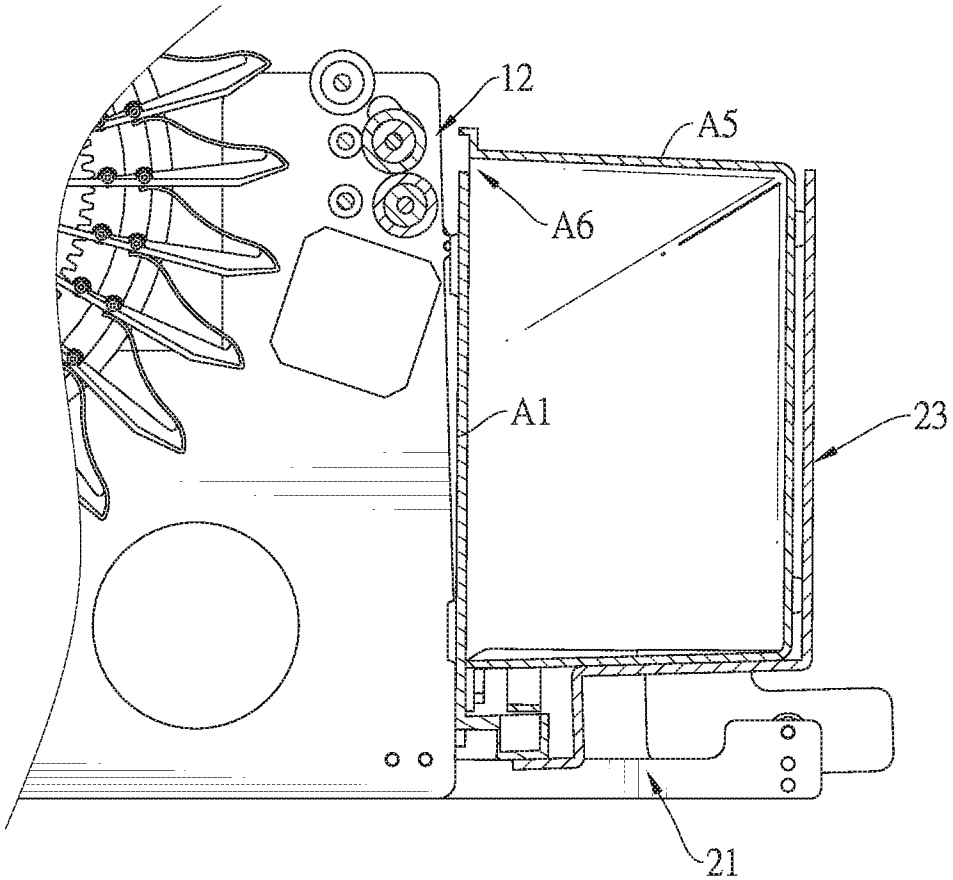
Figure 7:
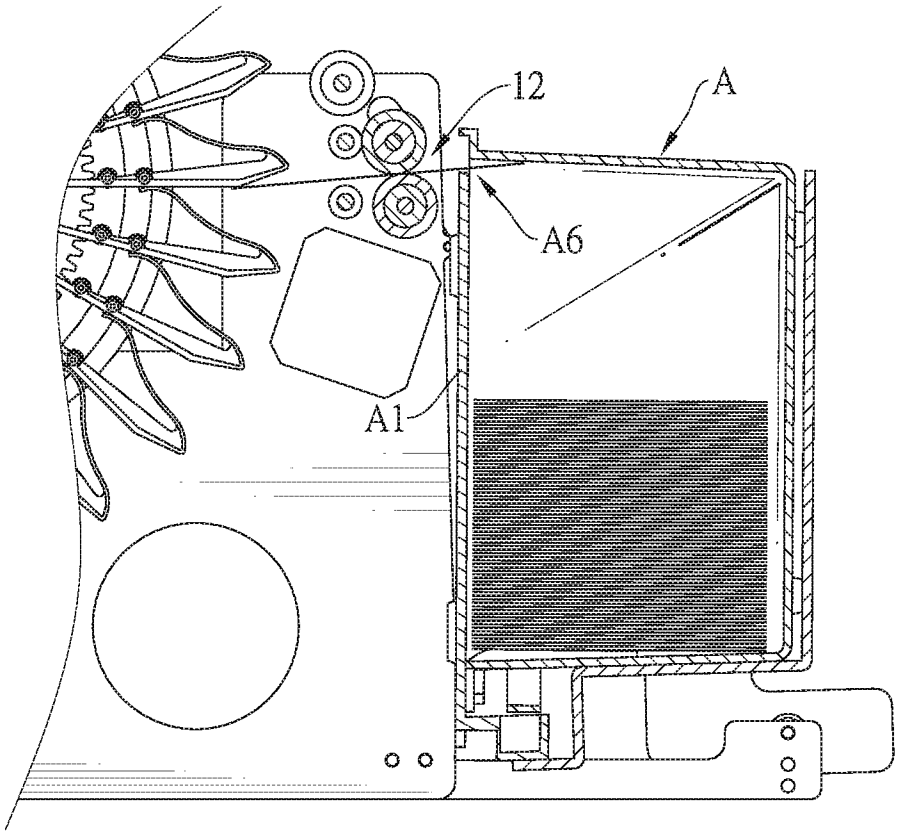
Figure 8:
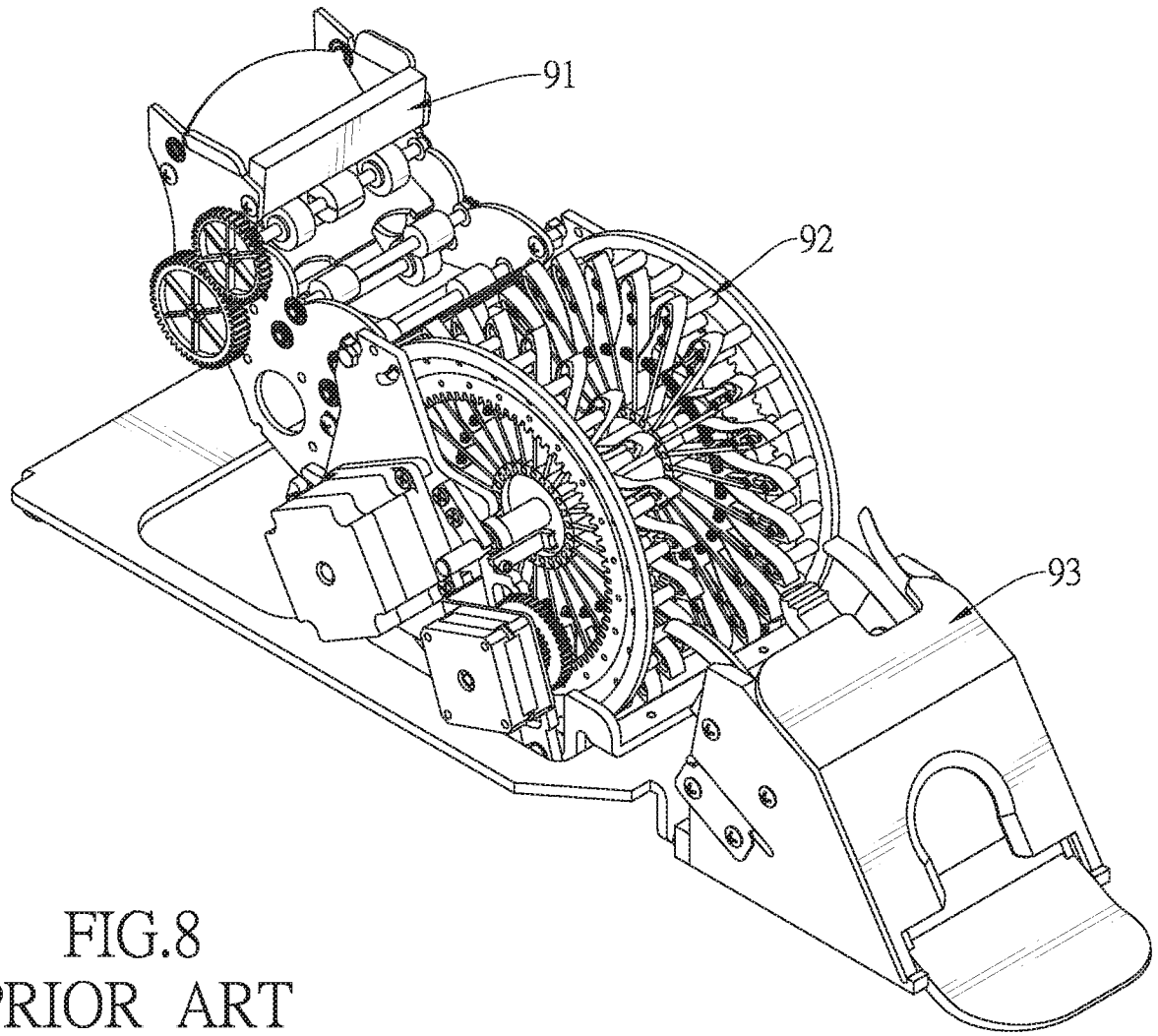
FIG.8 PRIOR ART
FIG. 8 is a perspective view of a conventional automatic card shuffler in accordance with the prior art.

With further reference to FIGS. 5, 6 and 7, the pivot shelf 23 is pivotally connected on the connecting arm 21 and is to accommodate the card box A. The pivot shelf 23 is adapted to pivot relative to the connecting arm 21 to a first position or a second position.

When the pivot shelf 23 pivots to the first position, the placing surface A3 of the card box A is located in a bottom of the card box A and the pivot shelf 23 abuts the pivot stopper 22 (as shown in FIG. 5). But the orientation in which the card box A is disposed in the first position is not limited to the abovementioned. The card box A can be disposed in any orientation such that it is easy to seal the cover A1.

When the pivot shelf 23 pivots to the second position, the abutting surface A2 of the card box A is located in the bottom of the card box A and the pivot shelf 23 makes the opening A6 of the card box A aligned to the card exit 12 of the shuffling device 10 (as shown in FIG. 6).

Specifically, when in the first position, the card box A is substantially laid flat. At this time, the card box A is placed on the pivot shelf 23 in a conventional way (the placing surface A3 serving as a bottom surface and the card box A laid flat). When in the second position, the card box A is substantially standing upright with the abutting surface A2 being the bottom surface. At this time the gravity makes the cover A1 slide toward the abutting surface A2 (sliding downward) and open the opening A6, and the opening A6 is exactly aligned to the card exit 12 of the shuffling device 10. Therefore, when the shuffling device 10 dispenses the poker cards from the card exit 12, the poker cards pass through the opening A6 of the card box A, enter the card box A, and are stacked in the card box A facing to the abutting surface A2.

In addition, with further reference to FIGS. 2 and 3, in this embodiment, the pivot shelf 23 has a pivot segment 231, an abutting segment 232, a placing segment 233, a cover stopping segment 234, and two side baffle segments 235.

The pivot segment 231 is pivotally connected to the second end of the connecting arm 21. When the pivot shelf 23 pivots to the first position, the pivot shelf 23 abuts the pivot stopper 22 by the pivot segment 231.

The abutting segment 232 is connected to the pivot segment 231 and pivots along with the pivot segment 231. The abutting segment 232 is adapted to abut the abutting surface A2 of the card box A.

The placing segment 233 is connected to the pivot segment 231 and pivots along with the pivot segment 231. The placing segment 233 is adapted to abut the placing surface A3 of the card box A.

The cover stopping segment 234 is connected to the pivot segment 231 and pivots along with the pivot segment 231. When the cover A1 abuts the cover stopping segment 231, the cover A1 of the card box A is opened. Specifically, when the pivot shelf 23 pivots to the second position, the cover A1 of the card box A abuts the cover stopping segment 234 by a downward periphery. In other words, when the cover A1 slides down due to the gravity to a certain extent, the downward periphery of the cover A1 abuts the cover stopping segment 234 and therefore the cover A1 stops sliding.

The two side baffle segments 235 are connected to the pivot segment 231 and pivots along with the pivot segment 231. The two side baffle segments 235 are adapted to respectively abut the two first surfaces A4 of the card box A in order to keep the card box A from falling from the two sides.

Furthermore, in this embodiment, the pivot segment 231, the abutting segment 232, the placing segment 233, the cover stopping segment 234, and the two side baffle segments 235 of the pivot shelf 23 are formed integrally. Additionally, the abutting segment 232 has a first edge 2321, a second edge 2322, a third edge 2323, and a fourth edge 2324. The first edge 2321 and the third edge 2323 are two opposite edges, and the second edge 2322 and the fourth edge 2324 are two opposite edges. The pivot segment 231 is connected to the first edge 2321 or the third edge 2322 of the abutting segment 232. The placing segment 233 is connected to the fourth edge 2324 of the abutting segment 232 and forms a corner with the abutting segment 232. The cover stopping segment 234 is connected to the second edge 2322 of the abutting segment 232. The two side baffle segments 235 are respectively connected to the first edge 2321 and the third edge 2323 of the abutting segment 232, and each of the side baffle segments 235 forms a corner with the abutting segment 232.

The specific structure of the pivot shelf 23 is not limited to be formed integrally, and the pivot shelf 23 can also be implemented without the pivot segment 231, the abutting segment 232, the placing segment 233, the cover stopping segment 234, or the side baffle segment 235. The pivot shelf 23 only needs to be adapted to accommodate the card box A and to pivot relative to the connecting arm 21 to the first position and the second position.

By pivotally connecting the pivot shelf 23 on the connecting arm 21, the pivot shelf 23 can be turned to the first position and the card box A can be placed on the pivot shelf 23 by using the placing surface A3 as the bottom surface. Then, the pivot shelf 23 is turned to the second position and the card box A is turned into a position where the abutting surface A2 is disposed as the bottom surface. As this time, the gravity makes the cover A1 slide toward the abutting surface A2 (slide down) and open the opening A6, and the opening A6 is aligned to the card exit 12 of the shuffling device 10. Therefore, when the shuffling device 10 dispenses the poker cards from the card exit 12, the poker cards pass through the opening A6 of the card box A, enter the card box A, and are stacked inside the card box A facing to the abutting surface A2. At last, the staff of the casino seals the card box A until a new deck of poker cards is needed. Therefore, by continuously shuffling multiple decks of poker cards and delivering them into multiple card boxes to be sealed, a new shuffled deck can be immediately provided to be unpacked and used after the last deck is fully used. Thus, all the poker tables in the casino can be run by only one automatic card shuffler so that the cost is massively reduced and the waiting time between rounds is significantly shortened.

Additionally, the automatic card shuffler in accordance with the present invention is not limited to be used for poker cards only. The automatic card shuffler can also be used for any other cards as long as the cards fit the shuffling device 10 and the card box A.

Even though numerous characteristics and advantages of the present invention have been set forth in the foregoing description, together with details of the structure and features of the invention, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. A card box rack adapted to be mounted on a shuffling device to accommodate a card box, wherein the shuffling device has a card exit, and the card box is a hexahedron and has a cover, an abutting surface, a placing surface, and two first surfaces; the cover and the placing surface being two opposite surfaces of the card box respectively; the abutting surface connected between the cover and the placing surface; the two first surfaces being another two opposite surfaces of the card box respectively and each of the first surfaces connected between the cover, the abutting surface, and the placing surface; the cover adapted to be opened to form an opening; the card box rack comprising:

a connecting arm having a first end adapted to be mounted on the shuffling device; and a second end being opposite to the first end;

a pivot stopper mounted on the connecting arm; and a pivot shelf pivotally connected to the connecting arm and adapted to accommodate the card box; the pivot shelf adapted to pivot relative to the connecting arm to a first position or a second position; wherein when the pivot shelf pivots to the first position, the placing surface of the card box is located in a bottom of the card box and the pivot shelf abuts the pivot stopper; when the pivot shelf pivots to the second position, the abutting surface of the card box is located in the bottom of the card box and the pivot shelf makes the opening of the card box aligned to the card exit of the shuffling device.

2. The card box rack as claimed in claim 1, wherein the pivot shelf has a pivot segment pivotally connected on the second end of the connecting arm;

an abutting segment connected to the pivot segment and pivoting along with the pivot segment; the abutting segment adapted to abut the abutting surface of the card box; and a placing segment connected to the pivot segment and pivoting along with the pivot segment; the placing segment adapted to abut the placing surface of the card box.

3. The card box rack as claimed in claim 2, wherein the abutting segment has a first edge;

a second edge;

a third edge being opposite to the first edge; and a fourth edge being opposite to the second edge;

the pivot segment is connected to the first edge or the third edge of the abutting segment; and the placing segment is connected to the fourth edge of the abutting segment and forming a corner with the abutting segment.

4. The card box rack as claimed in claim 3, wherein the pivot shelf further has a cover stopping segment connected to the pivot segment and pivoting along with the pivot segment; wherein when the cover abuts the cover stopping segment, the cover of the card box is opened.

5. The card box rack as claimed in claim 4, wherein the cover stopping segment is connected to the second edge of the abutting segment.

6. The card box rack as claimed in claim 5, wherein the pivot shelf further has two side baffle segments connected to the pivot segment and pivoting along with the pivot segment; the two side baffle segments adapted to respectively abut the two first surfaces of the card box.

7. The card box rack as claimed in claim 6, wherein the two side baffle segments are respectively connected to the first edge and the third edge of the abutting segment, and each of the side baffle segments forms a corner with the abutting segment.

8. The card box rack as claimed in claim 7, wherein the pivot stopper is a column protruding from the connecting arm; when the pivot shelf pivots to the first position, the pivot shelf abuts against the pivot stopper with the pivot segment.

9. The card box rack as claimed in claim 3, wherein the pivot shelf further has two side baffle segments connected to the pivot segment and pivoting along with the pivot segment; the two side baffle segments adapted to respectively abut the two first surfaces of the card box.

10. The card box rack as claimed in claim 9, wherein the two side baffle segments are respectively connected to the first edge and the third edge of the abutting segment, and each of the side baffle segments forms a corner with the abutting segment.

11. The card box rack as claimed in claim 2, wherein the pivot shelf further has a cover stopping segment connected to the pivot segment and pivoting along with the pivot segment; wherein when the cover abuts the cover stopping segment, the cover of the card box is opened.

12. The card box rack as claimed in claim 11, wherein the cover stopping segment is connected to the second edge of the abutting segment.

13. The card box rack as claimed in claim 2, wherein the pivot shelf further has two side baffle segments connected to the pivot segment and pivoting along with the pivot segment; the two side baffle segments adapted to respectively abut the two first surfaces of the card box.

14. The card box rack as claimed in claim 2, wherein the pivot stopper is a column protruding from the connecting arm; when the pivot shelf pivots to the first position, the pivot shelf abuts against the pivot stopper with the pivot segment.

15. An automatic card shuffler adapted to accommodate a card box; wherein the card box is a hexahedron and has a cover, an abutting surface, a placing surface, and two first surfaces; the cover and the placing surface being two opposite surfaces of the card box respectively; the abutting surface connected between the cover and the placing surface; the two first surfaces being another two opposite surfaces of the card box respectively and each of the first surfaces connected between the cover, the abutting surface, and the placing surface; the cover adapted to be opened to form an opening; the automatic card shuffler comprising:

a shuffling device having a card entrance end having a card entrance; and a card exit end being opposite to the card entrance end and having a card exit; and a card box rack having a connecting arm having a first end mounted on the card exit end of the shuffling device; and a second end being opposite to the first end;

a pivot stopper mounted on the connecting arm; and a pivot shelf pivotally connected on the connecting arm and adapted to accommodate the card box; the pivot shelf adapted to pivot relative to the connecting arm to a first position or a second position; wherein when the pivot shelf pivots to the first position, the placing surface of the card box is located in a bottom of the card box and the pivot shelf abuts the pivot stopper; when the pivot shelf pivots to the second position, the abutting surface of the card box is located in the bottom of the card box and the pivot shelf makes the opening of the card box aligned to the card exit of the shuffling device.

* * * * *